US005407358A

United States Patent [19]

Gruber

[11] Patent Number: 5,407,358

[45] Date of Patent: Apr. 18, 1995

[54] VESTIBULE CLEANER

[76] Inventor: Jack Gruber, 54 Old Pond Rd., Great Neck, N.Y. 11023

[21] Appl. No.: 110,263

[22] Filed: Aug. 23, 1993

[51] Int. Cl.[6] ..... A61C 3/00

[52] U.S. Cl. ..... 433/141; 433/147; 15/167.1

[58] Field of Search ..... 433/141, 147; 15/110, 15/167.1; 128/62 A, 759

[56] References Cited

U.S. PATENT DOCUMENTS

| | | | |
|---|---|---|---|
| 877,585 | 1/1908 | Nicolai . | |
| 1,347,275 | 7/1920 | Iden . | |
| 1,371,790 | 3/1921 | Kelly . | |
| 1,620,990 | 3/1927 | Brothers . | |
| 1,729,167 | 9/1929 | Knapp . | |
| 2,101,363 | 12/1937 | De Rome | 15/227 |
| 2,218,738 | 10/1940 | Boysen | 132/84 |
| 2,985,167 | 5/1961 | Colb | 128/62 |
| 3,018,778 | 1/1962 | Brilliant | 128/269 |
| 4,195,625 | 4/1980 | Bukowski | 128/62 A |
| 4,323,347 | 4/1982 | Weissman | 433/141 |
| 4,486,109 | 12/1984 | Rosofsky | 401/24 |
| 4,638,521 | 1/1987 | Potente et al. | 15/111 |
| 4,731,896 | 3/1988 | de La Tour | 15/106 |
| 4,770,195 | 9/1988 | Dore | 132/73 |
| 4,831,676 | 5/1989 | Denmark | 15/104.93 |
| 5,027,796 | 7/1991 | Linzey | 128/62 |

FOREIGN PATENT DOCUMENTS

| | | |
|---|---|---|
| 1592513 | 10/1977 | United Kingdom . |

*Primary Examiner*—Nicholas D. Lucchesi
*Attorney, Agent, or Firm*—Pennie & Edmonds

[57] ABSTRACT

A device for cleaning the vestibule of the mouth. The device includes a rounded tapered end having a bend or curve with respect to a longitudinal axis of the device. The rounded end may be rotatable with respect to a handle portion of the device. The device may be used alone or in combination with a fabric sleeve to sweep matter from the vestibule.

14 Claims, 1 Drawing Sheet

VESTIBULE CLEANER

FIELD OF THE INVENTION

The invention relates to oral cleaning devices and, in particular, to a device for cleaning the vestibule of the mouth.

BACKGROUND OF THE INVENTION

The importance of oral hygiene in the maintenance of healthy teeth and gums is well recognized. Many devices have been developed for removing food particles and bacteria from the mouth and teeth which contribute to tooth and gum decay. Most commonly used are toothbrushes having bristles which are moved across the teeth to remove food residues from the surface thereof, as well as food particles trapped in between teeth. Toothpicks and dental floss are also frequently used to remove food particles which can become trapped between teeth, resulting in cavities and/or gum disease.

In addition to cleaning the teeth and gums, the folds of the mouth between the gums and cheeks, known as vestibule of the mouth, also require cleaning. Food particles and plaque which collect in the vestibule can contribute to tooth decay and gum disease and thus need to be removed. Toothbrushes are typically too abrasive for these sensitive tissue areas and can cause pain to the user. Further, the brushes are awkward and difficult to manipulate in the narrow folds between the gums and cheeks.

Toothpick-type devices are also ill-suited to clean the vestibule of the mouth. Toothpicks or similar devices do not have enough surface area to clean the folds of the mouth in an effective manner. In addition, the pointed tips on the toothpicks can injure the gums and surrounding tissues.

Fingers may also be used to clean the vestibule, however, depending upon the individual, the fingers may be too large or too short to access all areas of the vestibule. Further, germs and bacteria residing on the fingers or underneath fingernails can be spread to the mouth if fingers are inserted into the mouth to clean the vestibule.

SUMMARY OF THE INVENTION

The present invention provides a sanitary oral cleaning device particularly useful in cleaning the vestibule of the mouth. In accordance with the invention, the device comprises a handle having a rounded, curved end portion. The end portion may rotate with respect to the handle to facilitate access to all areas of the vestibule. The device may further include a gauze sleeve positioned over the end portion to collect food particles and bacteria contained within the vestibule swept away in the cleaning process.

In accordance with the invention, a device for cleaning the vestibule of a mouth comprises an elongated handle having first and second portions wherein one of the first and second portions includes a rounded end which is curved with respect to a longitudinal axis of the handle. The handle further includes a fabric sleeve positioned over the rounded end for collection of particles contained in the vestibule. The device may further include a rotation axis member positioned between the first and second portions of the handle to permit circumferential rotation of the rounded end about the longitudinal axis. The fabric sleeve may comprise sterilized gauze and the rounded end may be curved so as to conform to the curvature of the mouth.

In another aspect of the invention, a device for cleaning the vestibule of the mouth comprises a handle having a first portion including a flat rounded end to be grasped by a user and a second portion including a rounded end having a smooth surface for insertion into the mouth. The second portion is curved with respect to a longitudinal axis of the handle to conform to the curvature of the mouth. A fabric sleeve is positioned over the rounded end for collection of particles contained in the vestibule. The fabric sleeve may comprise sterilized gauze. The handle may be formed from a material selected from the group consisting of wood, plastic, or rubber. The device may further comprise a rotation axis member positioned between the first and second portions to enable circumferential rotation of the second portion of the handle with respect to the first portion about the longitudinal axis member.

The invention further provides an oral cleaning device comprising a first handle portion and a second handle portion having a rounded end, wherein the rounded end is curved with respect to a longitudinal axis of the device. A rotational axis member is positioned between the first and second handle portions which permits rotation of the second handle portion with respect to the first handle portion. The first handle portion may include a plurality of bristles secured thereto. The device may further include a fabric sleeve positioned over the rounded tapered end of the second handle portion and the sleeve may be formed of sterilized gauze.

DETAILED DESCRIPTION OF THE INVENTION

Figure 1:
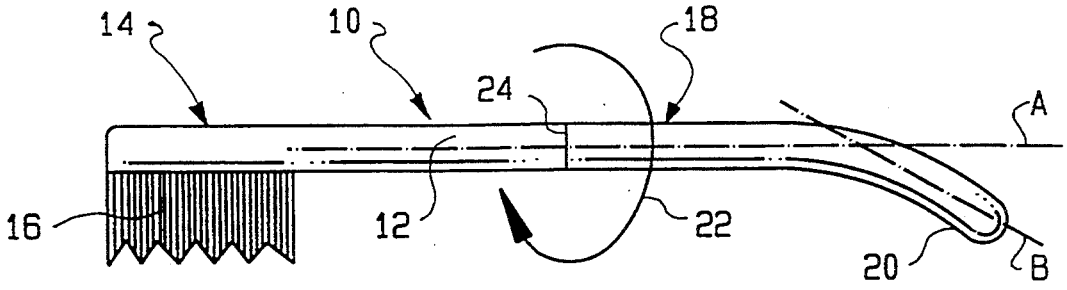
FIG. 1 is a side view illustrating an oral cleaning device in accordance with the present invention.

FIG. 1 illustrates an oral cleaning device 10 in accordance with the present invention. The device 10 comprises an elongated handle 12 formed of a suitable durable material such as plastic, rubber, or wood. A first portion 14 of the handle 12 includes a plurality of bristles 16 secured thereto which can be utilized to clean the teeth and gums in a conventional manner.

A second portion 18 of the handle 12, opposite the bristles 16, is particularly adapted to clean the vestibule of the mouth, i.e., the fold areas of the mouth between the gums and cheeks. This vestibule cleaner portion 18 includes an end 20 having a longitudinal axis B which forms an angle with respect to a longitudinal axis A of the handle. The end 20 of the vestibule cleaner is further rounded to remove all sharp edges therefrom.

Figure 2:
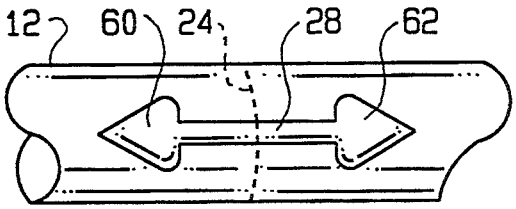
FIG. 2 is an enlarged partial view of the handle illustrating the rotation axis member.

Preferably, the vestibule cleaner portion 18 of the cleaning device is configured to circumferentially rotate with respect to the first portion 14 about the longitudinal axis A as indicated by the arrow 22. Referring to FIG. 2, to enable rotation in this manner, the handle 12 is segmented along a line 24. The device 10 includes a rotation axis member 28 having flexible ends 60, 62 which fit within corresponding apertures in the first and second portions 14, 18 of the handle 12. The circumferential rotation axis 28 is preferably formed of a flexible material, such as rubber so that, in addition to providing rotation, the axis further permits the vestibule cleaner portion 18 of the handle 12 to flex slightly during use.

In use, a user grasps the first portion 14 of the handle 12 and inserts the rounded end 20 of the vestibule cleaner portion 18 into the mouth. The user then moves the rounded end 20 in and around the vestibule of the mouth, sweeping away food particles and other bacteria, leaving the vestibule free of debris. The rotation of the second or vestibule cleaner portion 18 of the handle with respect to the first portion 14 and the curvature of the second portion enable access to all areas of the vestibule. The rounded edges of the vestibule cleaner portion 18 further provide a smooth contact surface that prevents curved abrasion of tissues during the cleaning process.

Figure 3:
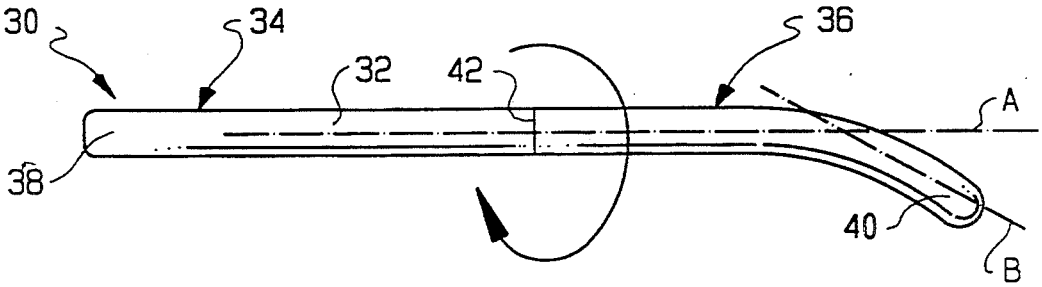
FIG. 3 is a side view of another embodiment of the invention.

Another embodiment of an oral cleaning device 30 in accordance with the invention is illustrated in FIG. 3. The device 30 comprises an elongated handle 32 having first and second portions 34, 36. The first portion 34 of the handle includes a generally flat rounded end 38. The second portion 36 of the handle 32 is identical to that described above including a rounded curved end 40 having a slight longitudinal axis B which forms an angle with respect to a longitudinal axis A of the handle. The portions of the handle 12 are segmented about a line 42. The device further includes a rotation axis 28 (not shown) as illustrated in FIG. 3 that enables the vestibule cleaner portion 36 to rotate circumferentially with respect to the first portion 34 of the handle 32 about the longitudinal axis A.

To clean the vestibule of the mouth, the device 30 is grasped by the flat rounded end 38 of the first portion 34 and the second portion 36 of the handle 32 is inserted into the mouth. The flat rounded end 38 enables the device to be comfortably held within the hand during the cleaning process. The vestibule cleaner portion 36 is then moved in and around the mouth to sweep away residual food particles and bacteria which may be present. As with the embodiment illustrated in FIG. 1, the vestibule cleaner portion 36 is circumferentially rotatable with respect to the first position 34 of the handle 32, to provide access to all areas of the vestibule.

Figure 4:
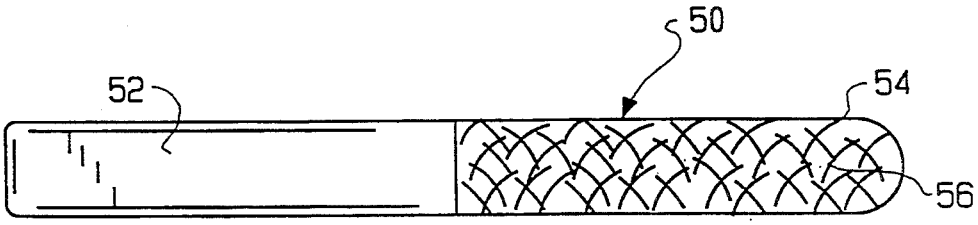
FIG. 4 is a top view of a further embodiment of the invention.

The device may also comprise a unitary handle 50 having a first portion 52 forming a grip and a second portion 54 having rounded end 56 for cleaning the vestibule as shown in FIG. 4. The rounded curved end 56 includes a slight longitudinal axis B which forms an angle with respect to a longitudinal axis A of the handle 50 to conform to the curvature of the mouth, facilitating access to all areas of the vestibule during the cleaning process.

The cleaning devices described above may be formed of any suitable durable material including wood, plastic, rubber. Combinations of these materials may also be used. For example, in the embodiment illustrated in FIGS. 1 and 3, the first portion of device may be formed of plastic, while the second portion may be formed of rubber.

In any of the embodiments described herein, the rounded curved end forming the vestibule cleaner may be covered with a disposable piece of woven material, such as gauze, which collects the food particles and plaque in the vestibule during cleaning. The fabric may be configured as a sleeve 50, illustrated in FIG. 4, to slip over the rounded curved end of the cleaning device, or may be further secured to the device with a suitable adhesive. The gauze may be provided in the form of disposable, sterilized gauze sleeves that may be replaced as needed.

For use in dental office settings, the device may be formed of rubber and sterilized in an autoclave prior to use, minimizing the transmission of germs. The device may also be formed of an inexpensive wood, rubber, or plastic and packaged individually, with or without a sterilized gauze sleeve, so as to be completely disposable.

As those skilled in the art will recognize, the dimensions of the handle and ends thereof can be varied as desired. A preferred width of the vestibule cleaner portion has been found to be approximately $\frac{1}{2}''$ while a preferred height of this portion has been found to be approximately $\frac{1}{4}''$. When configured as illustrated in FIGS. 3 and 4, a preferred device length has been found to be approximately 5".

As will be apparent to those skilled in the art, various modifications and adaptations of the embodiments described above will become readily apparent without departure from the spirit and scope of the invention, the scope of which is defined in the appended claims.

What is claimed is:

1. A device for cleaning the vestibule of a mouth comprising:

a handle having a first portion including a flat rounded end to be grasped by a user and a plurality of bristles for brushing teeth, and a second portion having an end with rounded edges and a smooth surface which is curved to conform to a curvature of said mouth; and a fabric sleeve positioned over and around said curved, rounded edge end and secured thereto by an adhesive for collection of particles contained in the vestibule.

2. The device of claim 1 wherein said handle is formed of a material selected from the group consisting of wood, plastic, or rubber.

3. The device of claim 1 further comprising a rotation axis member operatively associated with said first and second portions to enable circumferential rotation of said second portion of said handle with respect to said first portion.

4. The oral cleaning device of claim 3 wherein the rotation axis member is an elongated rod having flexible ends which fit into corresponding apertures of the first and second handle portions.

5. An oral cleaning device comprising:

a first handle portion;

a second handle portion having a rounded and curved end and a longitudinal axis;

a sleeve positioned over said rounded and curved end of the second handle portion; and a rotational axis member positioned between said first and second handle portions which permits circumferential rotation of said second handle portion with respect to the longitudinal axis of said first handle portion; wherein the sleeve is secured to the second handle portion by an adhesive.

6. The oral cleaning device of claim 5 wherein said first handle portion includes a plurality of bristles secured thereto.

7. The oral cleaning device of claim 5 wherein said sleeve is formed of sterilized gauze.

8. The oral cleaning device of claim 5 wherein the rotation axis member is an elongated rod having flexible ends which fit into corresponding apertures of the first and second handle portions.

9. The oral cleaning device of claim 5 wherein the rotation axis member is made of a flexible material so that the handle can flex slightly during use.

10. A device for cleaning the vestibule of a mouth comprising: an elongated handle having first and second portions, the first portion being elongated and having a longitudinal axis, and the second portion having an end with rounded edges and a smooth surface which is curved, wherein said end has a longitudinal axis which is angled with respect to the longitudinal axis of the first portion, said second portion further including a fabric sleeve of sterilized gauze positioned over and around said curved end for collection of particles contained in the vestibule; wherein the sleeve is secured to the second handle portion by an adhesive.

11. The cleaning device of claim 10 further including a rotation axis member positioned between said first and second portions of said handle to permit circumferential rotation of said curved end about said longitudinal axis of the first portion.

12. The oral cleaning device of claim 11 wherein the rotation axis member is an elongated rod having flexible ends which fit into corresponding apertures of the first and second handle portions.

13. The device of claim 10 wherein said curved end conforms to a curvature of said mouth.

14. The device of claim 10 wherein said fabric sleeve is comprised of sterilized gauze.

* * * * *